US007750807B2

(12) United States Patent
Deng et al.

(10) Patent No.: US 7,750,807 B2
(45) Date of Patent: Jul. 6, 2010

(54) MOBILE COMMUNICATION DEVICE, ANTI-THEFT METHOD AND SYSTEM

(75) Inventors: Yong-Jun Deng, Shenzhen (CN); De-Zhi Li, Shenzhen (CN); Bing Li, Shenzhen (CN); Shih-Fang Wong, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 384 days.

(21) Appl. No.: 11/966,973

(22) Filed: Dec. 28, 2007

(65) Prior Publication Data

US 2008/0316030 A1 Dec. 25, 2008

(30) Foreign Application Priority Data

Jun. 21, 2007 (CN) ..... 2007 1 0200849

(51) Int. Cl.
*G08B 13/14* (2006.01)
*G08B 19/00* (2006.01)
*A45C 1/06* (2006.01)

(52) U.S. Cl. ..... 340/571; 340/568.1; 340/870.09; 150/134

(58) Field of Classification Search ..... 340/568.1, 340/571, 870.09; 150/134
See application file for complete search history.

(56) References Cited

U.S. PATENT DOCUMENTS

| | | | | |
|---|---|---|---|---|
| 3,824,576 | A * | 7/1974 | Pioch | 340/562 |
| 4,011,554 | A * | 3/1977 | Butler | 340/514 |
| 5,200,735 | A | 4/1993 | Hines | |
| 5,757,271 | A * | 5/1998 | Andrews | 340/568.1 |
| 5,796,338 | A * | 8/1998 | Mardirossian | 340/571 |
| 6,628,200 | B1 | 9/2003 | Lin | |
| 6,940,407 | B2 * | 9/2005 | Miranda-Knapp et al. | 340/572.1 |
| 7,135,971 | B2 | 11/2006 | Kim | |
| 2004/0155777 | A1 * | 8/2004 | Mitchell et al. | 340/568.1 |
| 2008/0157958 | A1 * | 7/2008 | Lin et al. | 340/539.11 |

* cited by examiner

*Primary Examiner*—George A Bugg
*Assistant Examiner*—Jack Wang
(74) *Attorney, Agent, or Firm*—Frank R. Niranjan

(57) ABSTRACT

A mobile communication device is provided herein. The mobile communication device includes a touch unit for generating a trigger signal when detecting a touch, a controller for generating an audible alarm in response to the trigger signal, and a transceiver for communicating wirelessly with an anti-theft device. The audible alarm, transmitted to the anti-theft device via the transceiver, is for enabling the anti-theft device to output a first alarm. An anti-theft system and method are also provided.

19 Claims, 5 Drawing Sheets

MOBILE COMMUNICATION DEVICE, ANTI-THEFT METHOD AND SYSTEM

BACKGROUND

1. Field of the Invention

The present invention relates to mobile communication devices, and particularly to an anti-theft method and system for protecting a mobile communication device from theft.

2. Description of Related Art

With the rapid development of mobile communication technology, mobile communication devices such as mobile phones are commonly used. Users often put their mobile communication devices in their pockets when they go to work, go shopping, etc. However, the mobile communication devices are stolen frequently, which causes inconvenience in the user's life.

Therefore, a mobile communication device, an anti-theft method and system for protecting the mobile communication device from theft are needed in the industry to address the aforementioned deficiencies and inadequacies.

SUMMARY

A mobile communication device is provided herein. The mobile communication device includes a touch unit for generating a trigger signal when detecting a touch, a controller for generating an audible alarm in response to the trigger signal, and a transceiver for communicating wirelessly with an anti-theft device. The audible alarm, transmitted to the anti-theft device via the transceiver, is for enabling the anti-theft device to output a first alarm. An anti-theft system and method are also provided.

Other advantages and novel features of the present invention will become more apparent from the following detailed description of preferred embodiment when taken in conjunction with the accompanying drawings.

DETAILED DESCRIPTION OF THE EMBODIMENTS

Reference will now be made to the drawings to describe a preferred embodiment of the present mobile communication device, anti-theft method and system for protecting the mobile communication device from theft.

Figure 1:
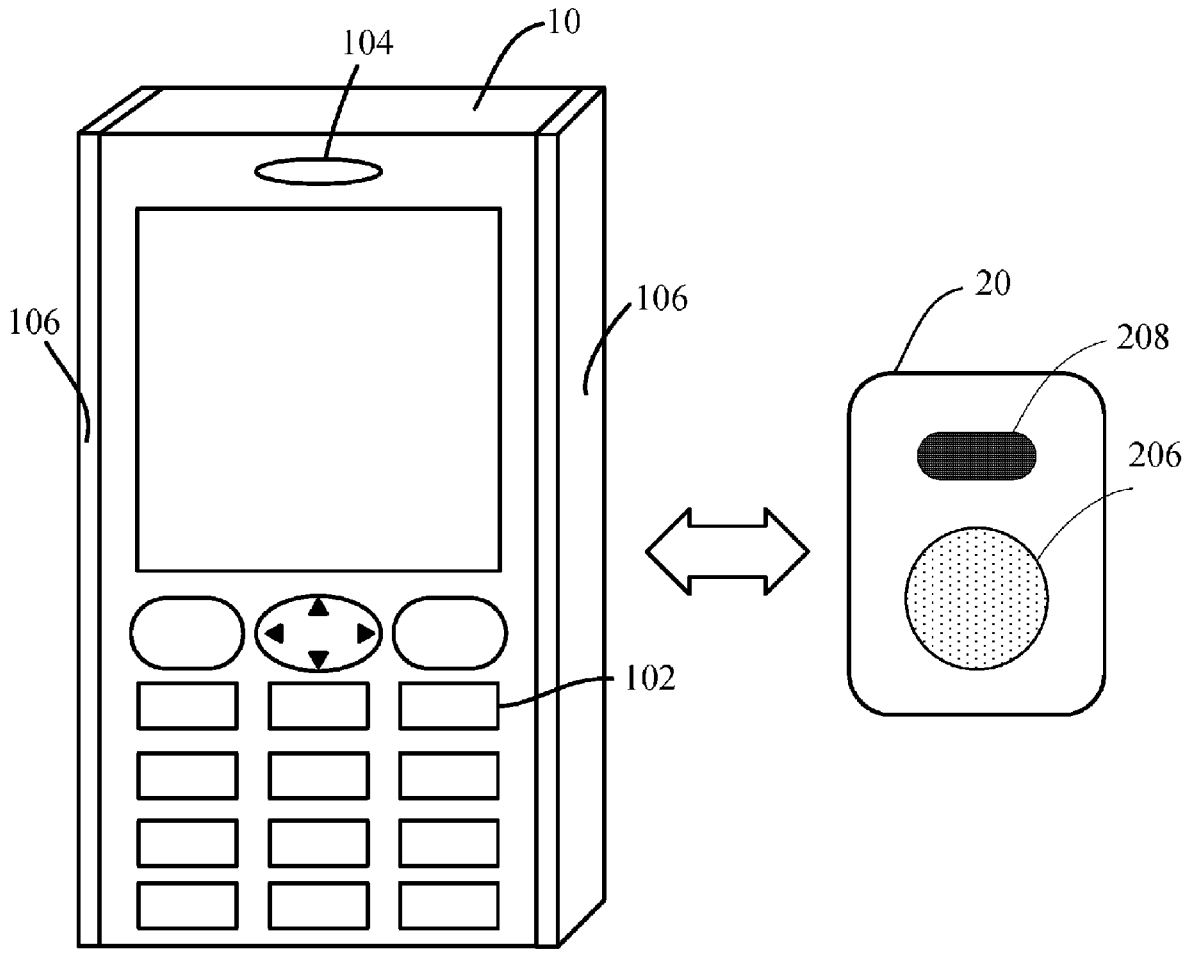
FIG. 1 is a block diagram showing a mobile communication device and an anti-theft device in accordance with an exemplary embodiment.

FIG. 1 shows an anti-theft system (not labeled) including a mobile communication device 10 and an anti-theft device 20 in accordance with an exemplary embodiment. In the embodiment, the mobile communication device 10 outputs a first alarm and wirelessly controls the anti-theft device 20 to output a second alarm when the mobile communication device 10 detects a touch action. Thus, notifying a user that the mobile communication device is being touch or used and possible stolen, and giving warning to the thief. If the mobile communication device 10 is lost or can not be found, the user can press a button 208 of the anti-theft device 20, and the mobile communication device 10 will output a third alarm to indicate a position of the mobile communication device 10. Thus, the user can locate and retrieve the mobile communication device 10.

Figure 2:
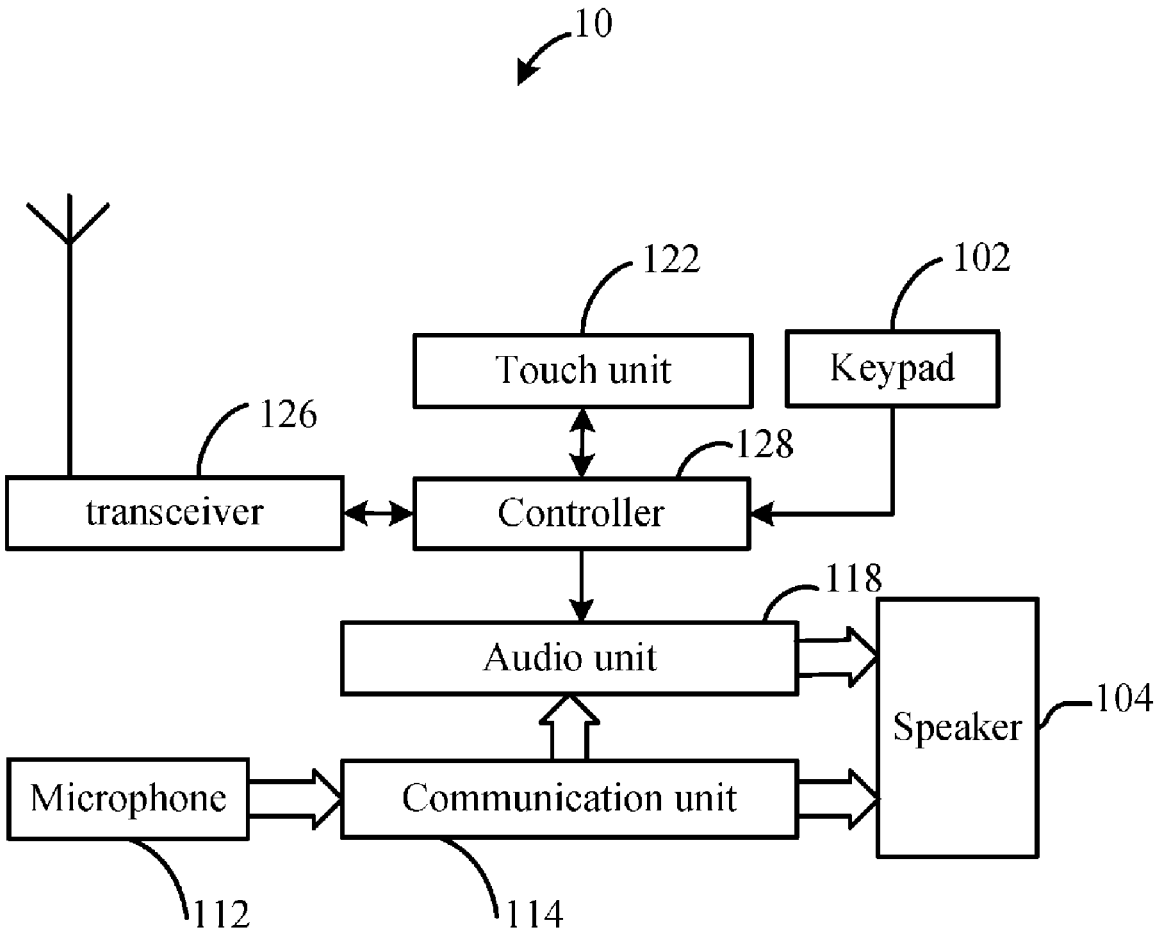
FIG. 2 is a block diagram showing a structure of the mobile communication device of FIG. 1.
Figure 3:
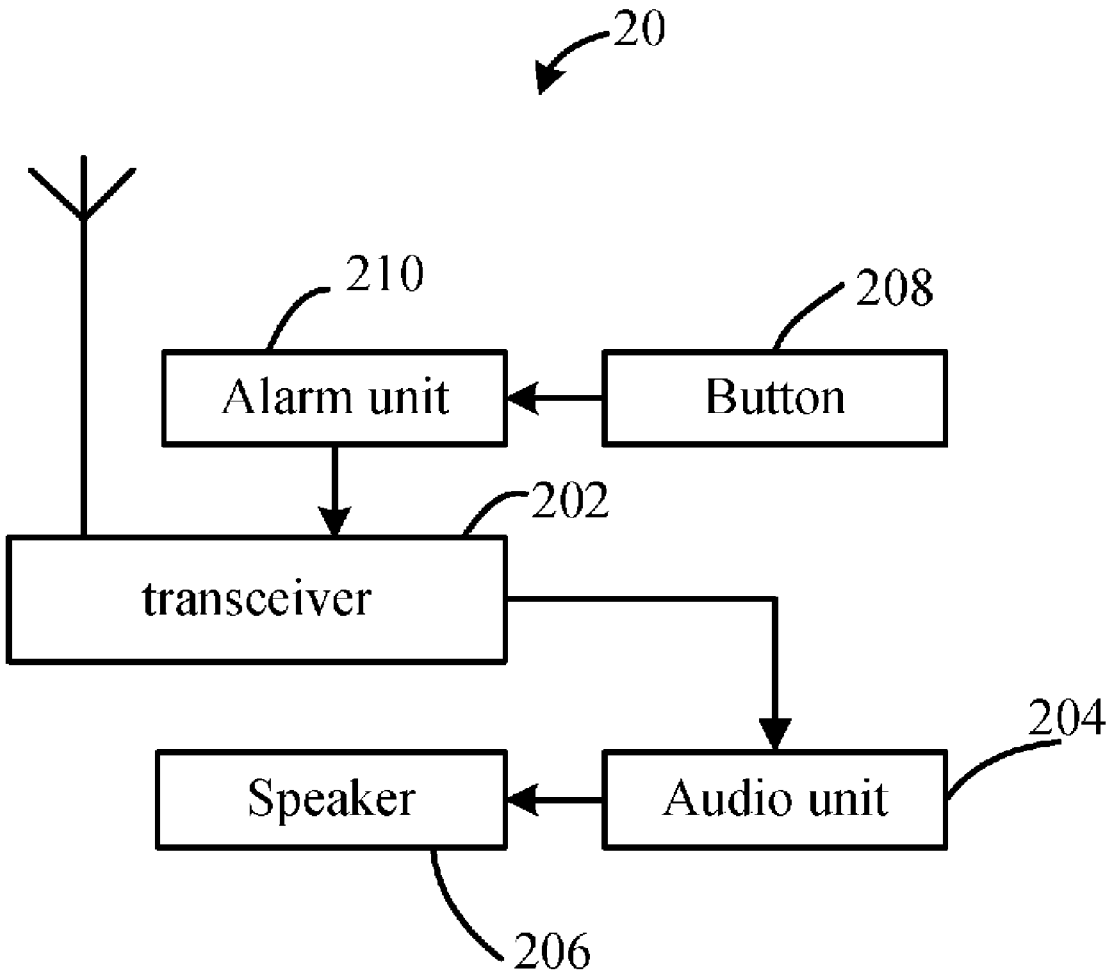
FIG. 3 is a block diagram showing a structure of the anti-theft device of FIG. 1.

Referring also to FIGS. 2 and 3. The mobile communication device 10 includes a keypad 102, a speaker 104, a microphone 112 (not shown in FIG. 1), a communication unit 114, an audio unit 118, a touch unit 122 including two touch sensors 106, a transceiver 126, and a controller 128. The anti-theft device 20 includes a transceiver 202, an audio unit 204, a speaker 206, the button 208, and an alarm unit 210.

In the mobile communication device 10, the microphone 112, the communication unit 114 and the speaker 104 are configured for making phone calls. The transceiver 126 is configured for communicating with the transceiver 202 of the anti-theft device 20.

The keypad 102 is configured for generating control signals to enable corresponding functions of the mobile communication device 10 in response to operations of a user. For example, the keypad 102 can enable an anti-theft function to protect the mobile communication device 10 from theft, making malicious/elicit phone calls, etc. In the embodiment, a key or a first key combination (not labeled) of the keypad 102 is configured for generating a switch-on signal or a switch-off signal. The keypad 102 outputs the switch-on signal when the key or the first key combination is pressed for a predetermined time. The keypad 102 outputs the switch-off signal when the key or the first key combination is pressed again for the predetermined time.

The touch sensors 106 of the touch unit 122 are configured for generating a trigger signal when detecting a touch to control the mobile communication device 10 and/or the anti-theft device 20 to output the first alarm and/or the second alarm. In the embodiment, the touch sensors 106 are disposed at two longer edges on opposite sides of the mobile communication device 10. This is because the mobile communication device 10 is usually picked up by the edges, thus, the edges would be touched.

The audio unit 118 is configured for decoding a compressed audio files (a first or third compressed audio file, for example) and outputting corresponding analog audio signals (first or third analog audio signals, for example) to the speaker 104 under control of the controller 128. Then, the speaker 104 converts the corresponding analog audio signals into sound (first or third alarm, for example).

The controller 128 is configured for enabling the anti-theft function, that is, enabling the touch unit 122 when receiving the switch-on signal, disabling the touch unit 122 when receiving the switch-off signal from the keypad 102, and generating an audible alarm and a first play signal when receiving the trigger signal. The audible alarm is then sent to the anti-theft device 20 via the transceiver 126 to control the anti-theft device 20 to output the second alarm. The first play signal is sent to the audio unit 118 to control the audio unit 118 to decode the first compressed audio file, and then the speaker 104 outputs the first alarm to notify the user that the mobile communication device is being touch or used and possible stolen.

In the embodiment, the controller 128 can generate a cancel signal to control the anti-theft device 20 to stop outputting the second alarm and disable the audio unit 118, thus stopping a false alarm. The cancel signal can be generated when the controller 128 receives any of the control signals from the keypad 102, or when a predetermined second key combination is pressed.

In the anti-theft device 20, the audio unit 204 is configured for decoding a second compressed audio file and outputting a second analog audio signals to the speaker 206 when receiving the audible alarm via the transceiver 202. Then the speaker 206 converts the second analog audio signals into the second alarm to, again, alert/signal that the phone was stolen.

The button 208 is configured for generating a key-press signal when pressed. The alarm unit 210 is configured for generating a ring signal when receiving the key-press signal, and sending the ring signal to the mobile communication device 10 via the transceiver 202. The controller 128 of the mobile communication device 10 generates a second play signal when receiving the ring signal. The audio unit 118 converts a third compressed audio file into third analog audio signals in response to the second play signal. The speaker 104 finally transmits the third analog audio signals into the third alarm. Thus the mobile communication device 10 can be located by following the source of the third alarm.

As described above, the user can enable the anti-theft function when he thinks it is necessary. After the anti-theft function is enabled, the mobile communication device 10 and anti-theft device 20 will output the first and second alarms when the mobile communication device 10 detects a touch, thus, alarming the user that the mobile communication device is being touch or used and possible stolen. Then the user can check on the mobile communication device 10. If it is a false alarm, the user can press any key of the keypad 102 or press the second key combination to stop the alarm. If the mobile communication device 10 is lost, the user can press the button 208 to get the mobile communication device 10 outputting the third alarm, thus, locating and retrieving the mobile communication device 10.

Figure 4:
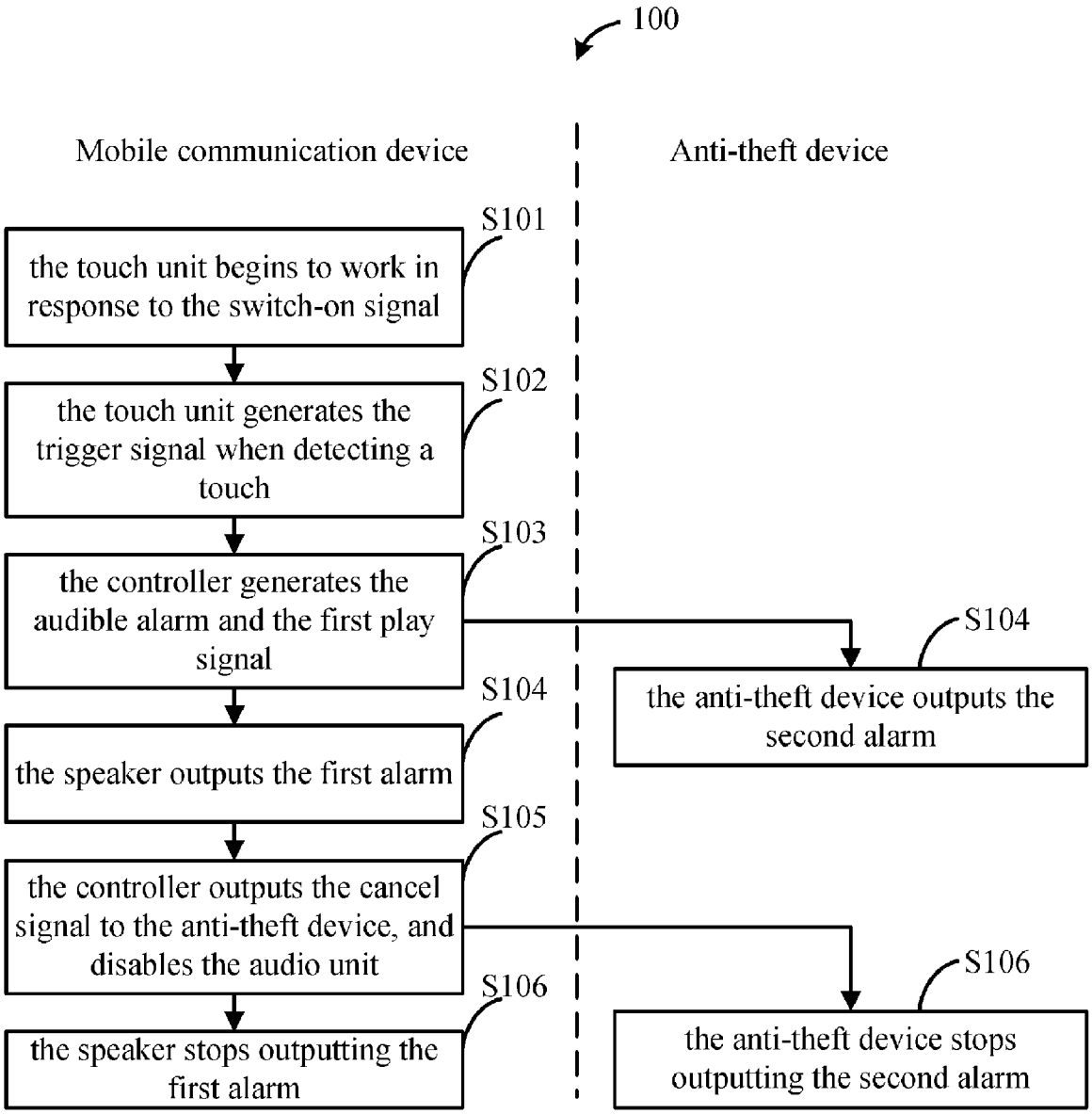
FIG. 4 is a process flow diagram illustrating an anti-theft method for protecting the mobile communication device of FIG. 2 from theft in accordance with an exemplary embodiment.

FIG. 4 is a process flow 100 illustrating an anti-theft method for protecting the mobile communication device 10 from theft in accordance with an exemplary embodiment. The anti-theft method includes the following steps:

In step S101, the touch unit 122 of the mobile communication device 10 begins to work in response to the switch-on signal outputted by the keypad 102.

In step S102, the touch unit 122 generates the trigger signal when detecting a touch.

In step S103, the controller 128 generates the audible alarm and the first play signal, transmits the audible alarm to the anti-theft device 20 via the transceiver 126, and transmits the first play signal to the audio unit 118.

In step S104, the anti-theft device 20 outputs the second alarm, and the audio unit 118 outputs the first analog audio signals to the speaker 104 which then outputs the first alarm to notify the user that the mobile communication device is being touch or used and possible stolen.

In step S105, the controller 128 generates the cancel signal in response to the operation of the user, outputs the cancel signal to the anti-theft device 20, and disables the audio unit 118.

In step S106, the anti-theft device 20 and the speaker 104 stops outputting the first and second alarm.

Figure 5:
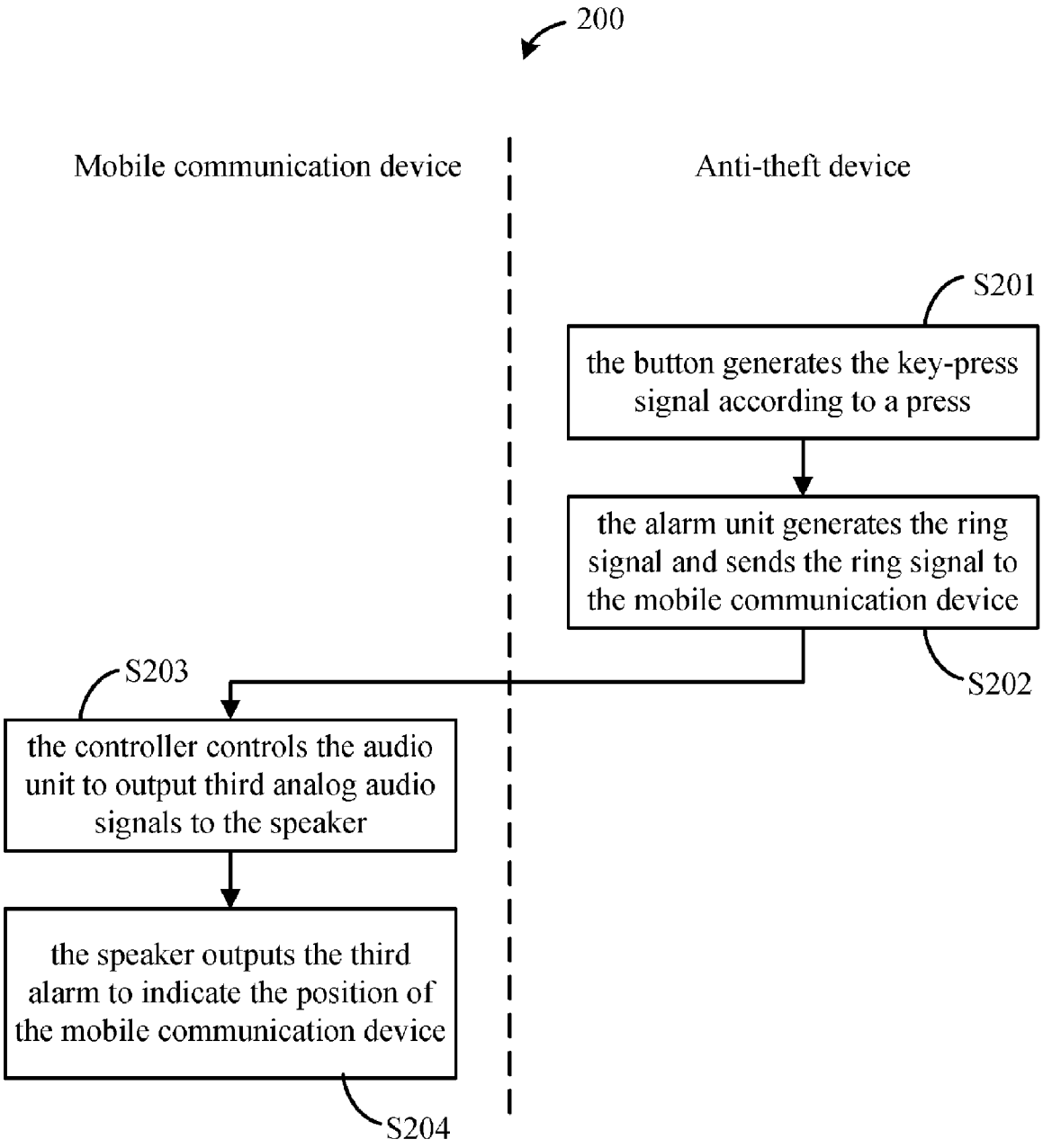
FIG. 5 is a process flow diagram illustrating an anti-theft method for locating the mobile communication device of FIG. 2 in accordance with an exemplary embodiment.

FIG. 5 is a process flow 200 illustrating an anti-theft method for locating the mobile communication device 10 in accordance with an exemplary embodiment. The anti-theft method includes the following steps:

In step S201, the button 208 of the anti-theft device 20 generates the key-press signal when pressed.

In step S202, the alarm unit 210 generates the ring signal when receiving the key-press signal, and sends the ring signal to the mobile communication device 10 via the transceiver 202.

In step S203, the controller 128 receives the ring signal via the transceiver 126, and generates the second play signal to control the audio unit 118 to output the third analog audio signals to the speaker 104.

In step S204, the speaker 104 outputs the third alarm to indicate a position of the mobile communication device 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A mobile communication device, comprising:

a touch unit for generating a trigger signal when detecting a touch;

a controller for generating an audible alarm in response to the trigger signal; and a transceiver for communicating wirelessly with an anti-theft device;

wherein the audible alarm, transmitted to the anti-theft device via the transceiver, is for enabling the anti-theft device to output a first alarm.

2. The mobile communication device as described in claim 1, wherein the touch unit comprising a touch sensor disposed at a longer edge of the mobile communication device.

3. The mobile communication device as described in claim 2, wherein the touch unit comprising another touch sensor; the two touch sensors disposed at two longer edges on opposite sides of the mobile communication device.

4. The mobile communication device as described in claim 1, wherein the controller is further used for generating a first play signal in response to the trigger signal; the mobile communication device further comprise an audio unit for converting a compressed audio file into analog audio signals when receiving the first play signal, and a speaker for transmitting the analog audio signals into a second alarm.

5. The mobile communication device as described in claim 4, wherein the controller is further used for generating a cancel signal to disable the audio unit and stop the anti-theft device outputting the first alarm.

6. The mobile communication device as described in claim 4, further comprising a microphone and a communication unit connected between the microphone and the speaker.

7. The mobile communication device as described in claim 1, further comprising a keypad for generating a switch-on signal to enable the touch unit, and a switch-off signal to disable the touch unit.

8. An anti-theft system, comprising a mobile communication device and an anti-theft device; wherein the mobile communication device comprises:

a touch unit for generating a trigger signal when detecting a touch;

a controller for generating an audible alarm in response to the trigger signal; and a first transceiver for communicating wirelessly with the anti-theft device;

the anti-theft device comprises:

a second transceiver for communicating wirelessly with the first transceiver;

a first audio unit for converting a first compressed audio file into first analog audio signals when receiving the audible alarm via the second transceiver;

a first speaker for converting the first analog audio signals into a first alarm.

9. The anti-theft system as described in claim 8, wherein the anti-theft device further comprises a button for generating a key-press signal when pressed, and an alarm unit for generating a ring signal in response to the key-press signal; the ring signal is sent to the mobile communication device via the second transceiver to control the mobile communication device to output a second alarm.

10. The anti-theft system as described in claim 8, wherein the touch unit comprising a touch sensor disposed at a longer edge of the mobile communication device.

11. The anti-theft system as described in claim 10, wherein the touch unit comprising another touch sensor; the two touch sensors disposed at two longer edges on opposite sides of the mobile communication device.

12. The anti-theft system as described in claim 8, wherein the controller is further used for generating a first play signal in response to the trigger signal; the mobile communication device further comprise a second audio unit for converting a second compressed audio file into second analog audio signals in response to the first play signal, and a second speaker for transmitting the second analog audio signals into a third alarm.

13. The anti-theft system as described in claim 12, wherein the controller is further used for generating a cancel signal to disable the audio unit and stop the anti-theft device outputting the first alarm.

14. The anti-theft system as described in claim 12, further comprising a microphone and a communication unit connected between the microphone and the speaker.

15. The anti-theft system as described in claim 8, further comprising a keypad for generating a switch-on signal to enable the touch unit, and a switch-off signal to disable the touch unit.

16. An anti-theft method for protecting a mobile communication device from theft, the anti-theft method comprising:

the mobile communication device generates a trigger signal when detecting a touch;

the mobile communication device generates an audible alarm in response to the trigger signal, and sends the audible alarm wirelessly to an anti-theft device;

the anti-theft device outputs a first alarm.

17. The anti-theft method as described in claim 16, further comprising: the mobile communication device outputs a second alarm in response to the touch.

18. The anti-theft method as described in claim 16, further comprising: the mobile communication device generates a cancel signal and stops outputting the second alarm.

19. The anti-theft method as described in claim 18, further comprising: the mobile communication device transmits the cancel signal to the anti-theft device;

the anti-theft device stops outputting the first alarm in response to the cancel signal.

* * * * *